US007464491B2

(12) United States Patent
Nakayama

(10) Patent No.: US 7,464,491 B2
(45) Date of Patent: Dec. 16, 2008

(54) PACKAGED SHOES

(76) Inventor: Yoko Nakayama, Flat 3, 25 The Avenue, Ealing, London (GB) W13 8JR ( * ) Notice: Subject to any disclaimer, the term of this patent is extended or adjusted under 35 U.S.C. 154(b) by 282 days.

(21) Appl. No.: 11/524,839

(22) Filed: Sep. 21, 2006

(65) Prior Publication Data

US 2008/0072452 A1 Mar. 27, 2008

(51) Int. Cl.
*A43B 3/28* (2006.01)

(52) U.S. Cl. ..... 36/112; 36/1

(58) Field of Classification Search ..... 36/102, 36/112, 1, 136, 9 R

See application file for complete search history.

(56) References Cited

U.S. PATENT DOCUMENTS 4,214,383 A * 7/1980 Allen ..... 36/1
5,109,616 A * 5/1992 Lush ..... 36/122
5,584,077 A * 12/1996 Thrift ..... 2/239
6,003,212 A * 12/1999 Imahata ..... 24/581.1
6,105,210 A * 8/2000 Benoit ..... 24/16 PB
6,446,361 B1 * 9/2002 Chun ..... 36/100
7,191,551 B2 * 3/2007 O'Connor et al. ..... 36/136
7,409,778 B2 * 8/2008 Steidle ..... 36/1
2006/0123659 A1 * 6/2006 Steidle ..... 36/1

* cited by examiner

*Primary Examiner*—Marie Patterson
(74) *Attorney, Agent, or Firm*—Andrus, Scaeles, Starke & Sawall, LLP

(57) ABSTRACT

A pair of casual shoes such as flip-flops are packaged for sale so as to have the general appearance of an essentially spherical ball. Each shoe has a flexible sole portion and an upper portion connected to at least part of the periphery of the sole portion by stitching, which extends around the entire sole portion periphery. The sole portion of each shoe is flexed generally into a U-shape and also is flexed transversely to the length thereof, and then the two U-shapes are interfitted with the toe and heel regions of one shoe fitting against the instep region of the other shoe. An elongate cord is laced between the stitching around the peripheries of the two sole portions so as to hold the two shoes together in the ball shape but removal of the cord release the two shoes for separation and opening out into a pair of flip-flops.

15 Claims, 3 Drawing Sheets

PACKAGED SHOES

CROSS REFERENCE TO RELATED APPLICATIONS

There are no related patent applications, neither within the United States nor elsewhere.

BACKGROUND OF THE INVENTION a) Field of the Invention

This invention relates to a packaged pair of casual shoes, each shoe of said pair comprising a sole portion and an upper portion, wherein the pair of shoes is packaged in a novel manner. The invention is primarily concerned with relatively flexible casual shoes such as flip-flops, moccasins, indoor slippers and the like.

b) Description of the Prior Art

Casual shoes such as flip-flops are very well known and generally comprise a sole portion together with an upper portion attached to the sole portion and which upper portion may take a variety of forms. In the case of a flip-flop, at its simplest the upper portion may comprise a simple strap extending from both sides of the instep region of the sole portion and conjoining to a toe post intended to lie between the big and first toes of the wearer's foot. Flip-flops with more extensive upper portions are also known, wherein the upper portion extends over a greater area of the wearer's instep but those flip-flops still have a toe post which is intended to pass between the toes of the wearer's foot.

Moccasin shoes generally have a sole portion which curves round the edge of a wearer's foot and has an upper portion stitched to that sole portion. Indoor (carpet) slippers may also have a similar construction to either flip-flops or moccasin shoes, again with a sole portion and an upper portion stitched thereto.

Casual shoes of the kind described above tend to be relatively low value and so often are not displayed for sale in a particularly attractive manner. Given that the profit on such casual shoes may be small, many retailers do not wish to present those products at the forefront of a display and so the presentation of the products to customers often is equally casual. The consequence is that a retailer may sell many fewer pairs of casual shoes than otherwise could be the case, were the shoes displayed in a more pleasing and attractive manner to the customers.

It is a principal object of this invention to provide a novel packaged pair of casual shoes, which enables the presentation of the shoes in a different and attractive way, whereby a display of the packaged shoes is more likely to result in increased sales of those shoes.

It is a further object of this invention to provide packaged casual shoes in such a way that the costs of packaging are much reduced as compared to the use of conventional shoe boxes of other materials such as cardboard.

Yet another object of this invention is to provide packaged casual shoes which require no other packaging materials once presented for display or when taken from a shop following purchase by a customer.

BRIEF SUMMARY OF THE INVENTION

According to this invention, there is provided a packaged pair of casual shoes each shoe of said pair comprising a flexible sole portion having a periphery, and an upper portion connected to at least a part of the periphery of the sole portion by stitching, said sole portion having a toe region at one end thereof, a heel region at the other end thereof and an instep region between said toe and heel regions, and each sole portion of each shoe being flexed round generally into a U-shape to be interfitted with the flexed round sole portion of the other shoe with the toe and heel regions of one shoe fitting against the instep region of the other shoe, and a connecting element arranged around the peripheries of the interfitting sole portions to hold together adjacent parts of said peripheries, whereby release of said connecting element allows the two shoes to be separated for opening out into a pair of casual shoes.

It will be appreciated that the pair of casual shoes as packaged is generally ball-shaped. It is a relatively easy matter to unpackage the shoes by releasing the connecting member so that the two shoes are separated, and then to open out each shoe from the flexed U-shape to the more usual generally flat state for a pair of shoes. Once done, the shoes may be worn in the normal manner.

BRIEF DESCRIPTION OF THE DRAWINGS

The drawings show a specific embodiment of packaged flip-flop shoes arranged in accordance with this invention, though solely by way of example. In the drawings.

DETAILED DESCRIPTION OF THE INVENTION

Figure 1:
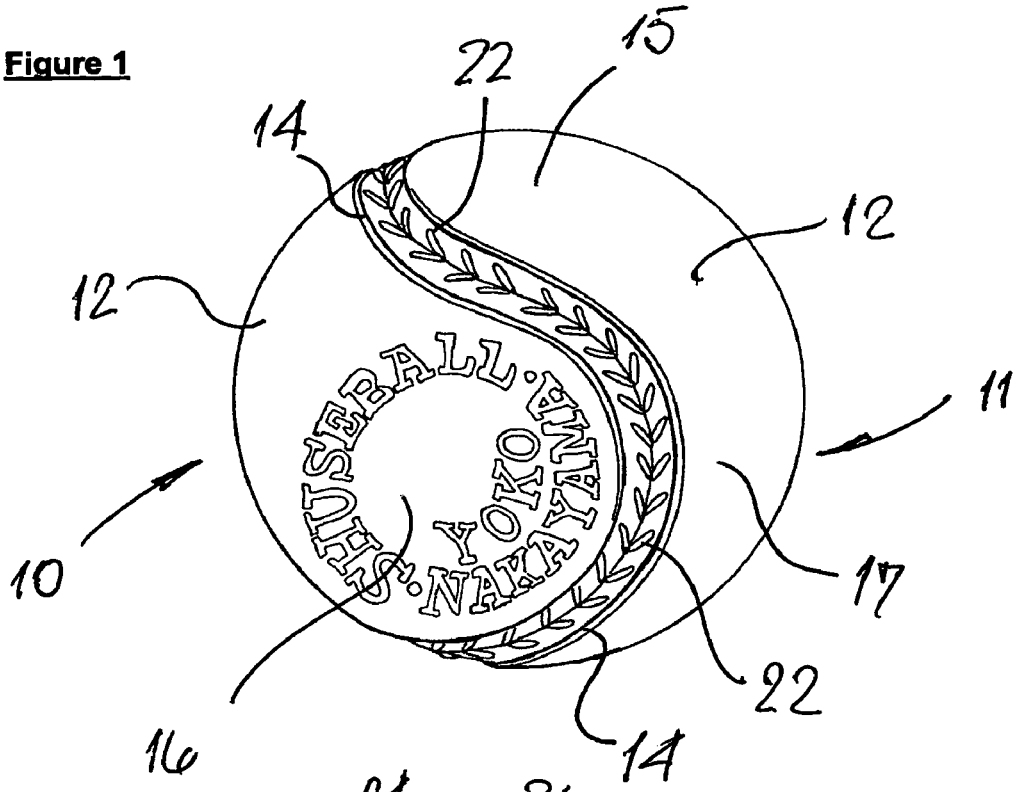
FIG. 1 shows from one viewpoint the packaged pair of shoes, in this case comprising a pair of flip-flop shoes and having certain markings on the sole portions thereof.

In packaging the casual shoes of this invention, it is highly preferred that the sole portions are flexed round in such a way that the upper portions thereof are disposed inwardly of the U-shape. Thus, when both shoes are flexed into said U-shape and interfitted, the sole portions of the two shoes are exposed externally and the upper portions are concealed within the interfitted sole portions. The sole portions may carry descriptive matter, for example printed thereon or perhaps embossed or otherwise formed thereon. Particularly in the case of the latter, the descriptive matter may then serve the dual purpose of providing extra grip, when the shoes are in use. However, before sale that descriptive matter may indicate the origin of the shoes, or perhaps the fact that the package is in fact a pair of shoes. Despite that, it is envisaged that the packaged shoes would normally be sold from a container or a display board which itself carries descriptive matter in an attractive and illustrative manner, whereby potential customers will appreciate the precise nature of the product being offered for sale.

In addition to flexing the sole portion of each shoe along the length thereof, from the toe region to the heel region, it is advantageous for the sole portion also to be flexed in a direction transverse to said length of the shoe, to be given a convex shape when viewed externally of the U-shape. In this way, when the sole portions of the two shoes are both in said U-shape and are interfitted, the appearance of the packaged shoes will be generally ball-like and resemble a softball.

A preferred embodiment of this invention employs a connecting member in the form of an elongate cord interlaced with the stitching around the peripheries of the two shoes. So long as the cord is not stitched but merely laced between the stitchings, it is a relatively easy matter to remove the cord and so release the two shoes. As an alternative to using an elongate cord, the connecting element may comprise a hook and loop fastener (such as that sold under the brand Velcro™), an adhesive, magnets or other suitable techniques.

In the case of a flip-flop shoe, the upper portion typically will not extend around the entire periphery of the associated sole portion. In order to allow such flip-flop shoes to be packaged in accordance with this invention, stitching must be provided around the entire periphery of the sole portion, in order to allow the lacing together of the two sole portions of the pair of shoes, even though not all of that stitching is used to secure together the sole and upper portions of the shoe.

A single cord may be laced between the stitchings of the two shoes and extend for substantially the whole of the peripheries of the two sole portions, whereby the peripheries of the two sole portions are held closely adjacent one another by the cord. The two end portions of the cord are preferably knotted together to prevent release of the cord other than when the shoes have been purchased and the purchaser wishes to open out those shoes, for wear. Conveniently, the end portions are secured together by means of a double-slipped reef knot, usually referred to as a bow.

Most preferably, the packaged shoes of this invention comprise a pair of flip-flops, wherein the upper portion thereof is in two pieces one of which pieces is stitched to the periphery of the sole portion at one side of the instep region thereof and the other of said pieces is stitched to the periphery of the sole portion at the other side of the instep region thereof. In this case the stitched-together parts of the sole portion and upper portion extend for a significant length of the periphery of the sole portion. The two pieces should also be stitched together in the toe region of the sole portion, so as to form the toe post of the shoe which toe post is secured to the sole portion.

Referring now to the drawings, these show a preferred embodiment of packaged shoes arranged in accordance with this invention and the opening out of those packaged shoes into a pair of flip-flops, ready for wear.

Each shoe 10,11 of the pair of flip-flops comprises a sole portion 12 and an upper portion 13. The sole portion has a periphery 14 and defines a toe region 15, a heel region 16 and an instep region 17. The toe and heel regions 15,16 are generally rounded, whereas the instep region 17 also is rounded but of concave profile form, though with a much larger radius of curvature than that of the toe and heel regions. The upper portion is formed in two parts 18,19 (see particularly FIG. 5), each of which has an edge 20 stitched to a part of the periphery 14 of the sole portion, along the instep region of the sole portion and running into the toe and heel regions thereof. Each upper portion part 18,19 has a forwardly extending strip 21 which strips are turned to overlie each other and are stitched together at 22. The ends of the strips are conjoined to the sole portion toe region 15, so as to form the toe post 23 of the flip-flop.

Figure 5:
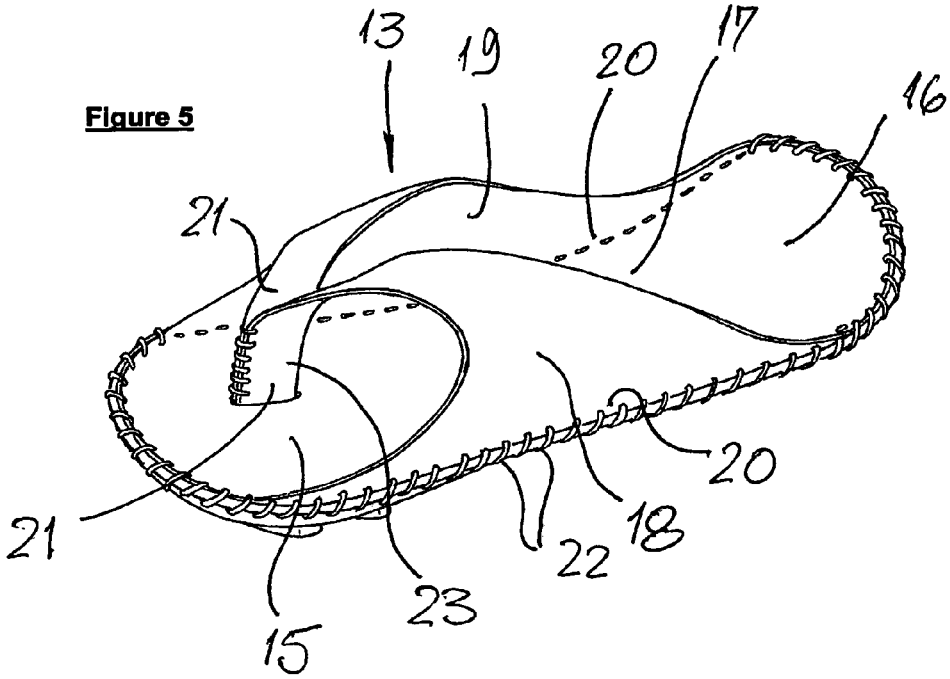
FIG. 5 shows one of the two shoes of the pair, fully opened out and ready to wear.
Figure 6:
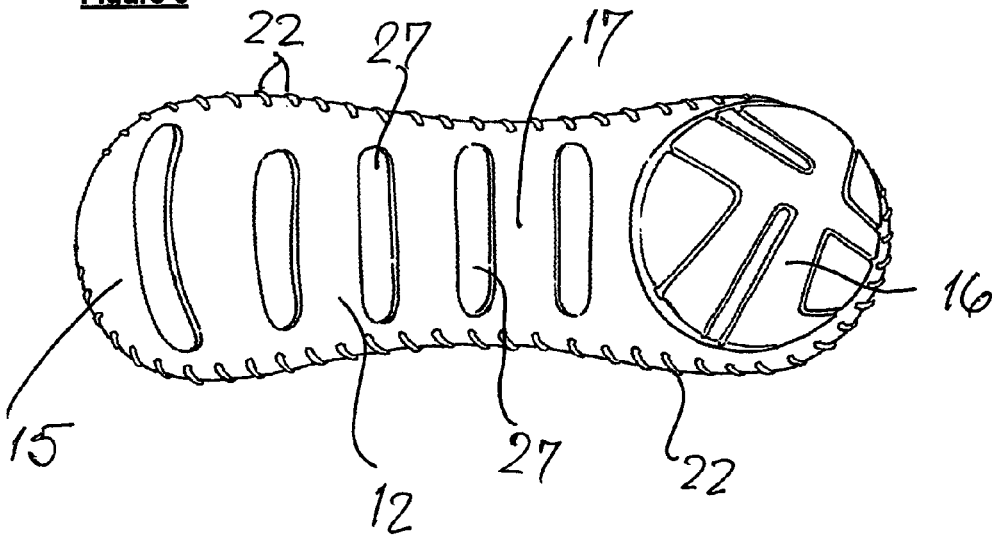
FIG. 6 is an underplan view of the one shoe of FIG. 5.

As shown particularly in FIGS. 5 and 6, the stitching extends around the entire periphery 14 of the sole portion, even though the two parts 18,19 of the upper portion 13 do not extend around that entire periphery.

The two flip-flop shoes are packaged together by flexing the sole portions 12 of the two shoes, in each case to form a general U-shape with the upper portions 13 disposed inwardly of the U-shape. The sole portion is thus curved in the direction of the length of the shoe from the toe region to the heel region. Further, the sole portion is also flexed in the direction transverse to the length of the shoe so that the sole portion has curvature in three dimensions. The two U-shaped sole portions are then interfitted together and the adjacent peripheries, each carrying stitches are connected together by a cord 24 (FIGS. 2 and 3) itself laced between the peripheral stitches. On pulling the cord tight, the two shoes form a generally ball-shaped packaged product, as shown in FIGS. 1 and 3.

The two ends 25 of the cord are tied together, so as to resist separation of the two shoes from the ball-shape. Conveniently, the two ends are tied by means of a double-slipped reef knot 26, in order to permit easy release when the packaged shoes are to be opened out. In the alternative, a more secure knot may be employed to prevent inadvertent release prior to sale of the packaged products, but then the cord may need to be cut to permit its release. The cord 24 may be similar to a conventional shoe-lace.

Figure 2:
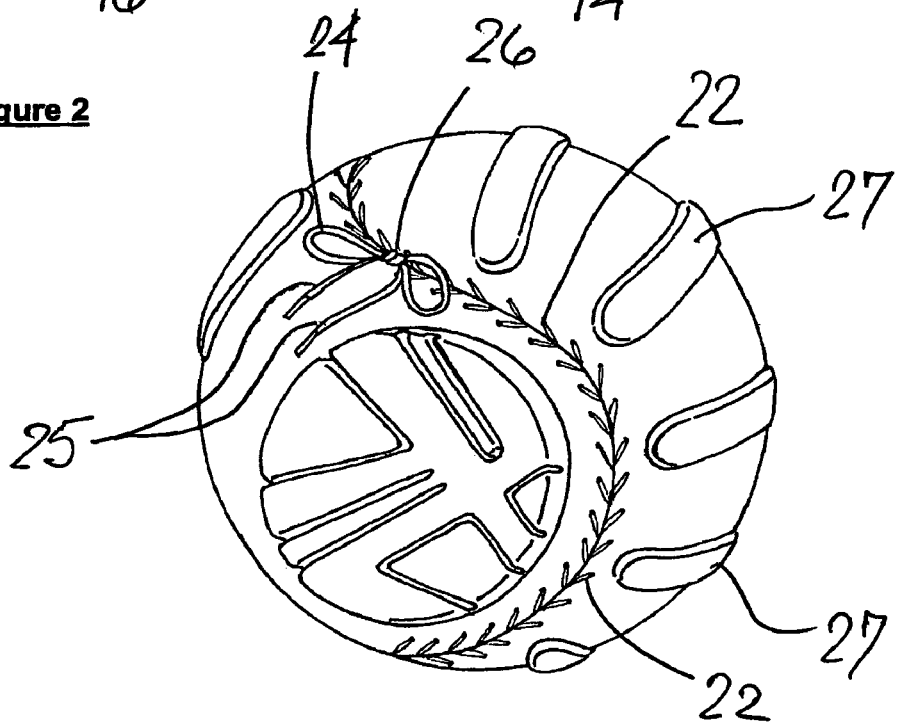
FIG. 2 shows the packaged pair of shoes of FIG. 1, but from a different viewpoint and showing the end portions of an interconnecting cord.
Figure 3:
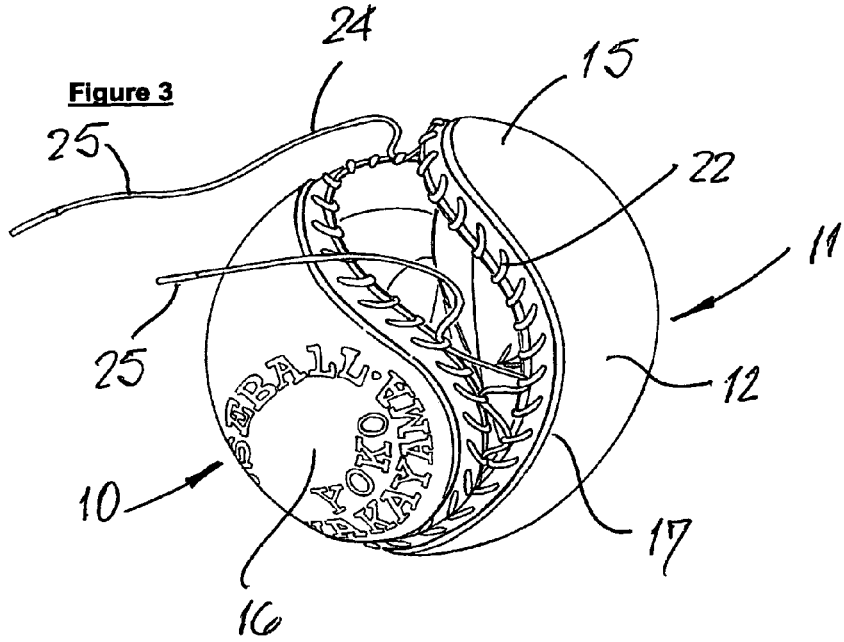
FIG. 3 shows the packaged pair of shoes of FIGS. 1 and 2 but with the cord released and partly removed, though with different markings on the sole portions of the shoes.

The packaged product as presented for sale is best seen in FIGS. 1 and 3. Following release of the knot 26, the cord 24 may be unthreaded from the peripheral stitches (FIG. 2) until the two shoes are wholly separated (FIG. 4) and the cord discarded. Then, each shoe may be straightened out, so as to be ready for wear (FIGS. 5 and 6).

Figure 4:
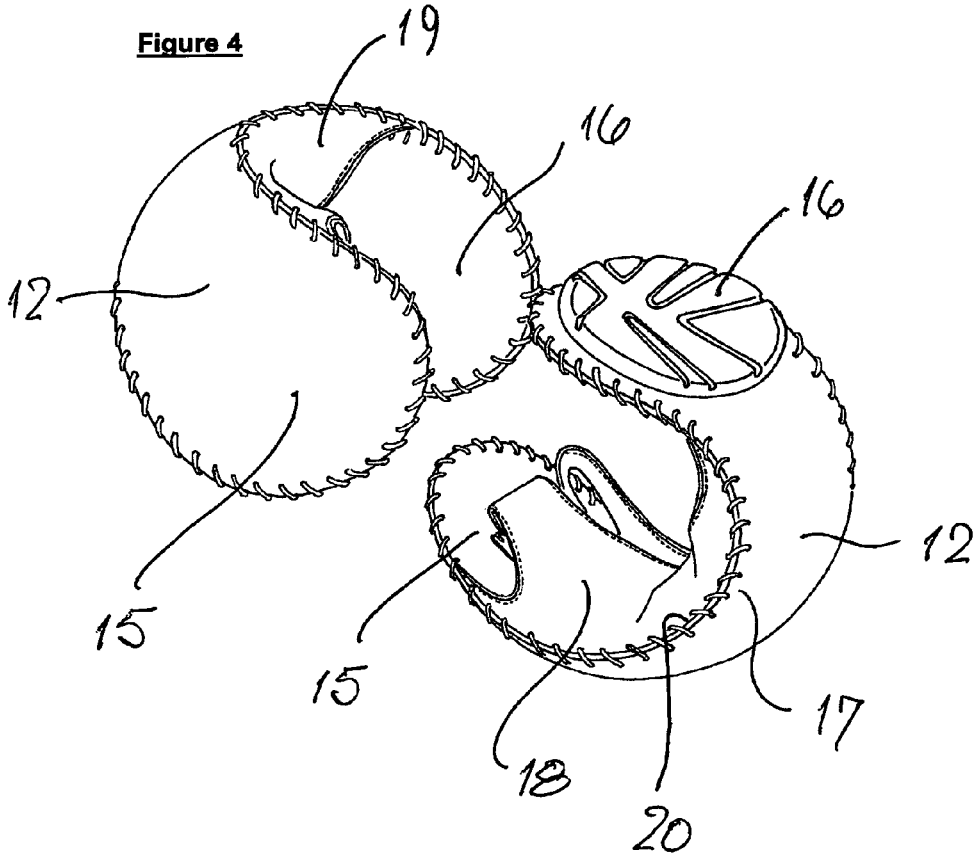
FIG. 4 shows the shoes with the cord wholly released from the two shoes of the pair, so that the two shoes are separated, but with grip bars on the sole portions shown in FIG. 3 not illustrated.

As shown in FIGS. 1 and 2, the underside (when in use) of the sole portions 12 may carry indications of the origin of the shoes, or of branding. That may be printed on the sole portions of the shoes or may be embossed during the manufacturing process. As shown in FIGS. 3, 4 and 6, the underside of the sole portions may be provided with grip-enhancing structures, such as transverse bars 27 and a heel formation 28. These structures preferably are embossed so as to upstand from the main area of the sole portion, by a small extent.

I claim:

1. A packaged pair of casual shoes each shoe of said pair comprising a flexible sole portion having a periphery, and an upper portion connected to at least a part of the periphery of the sole portion by stitching, said sole portion having a toe region at one end thereof, a heel region at the other end thereof and an instep region between said toe and heel regions, and each sole portion of each shoe being flexed round generally into a U-shape to be interfitted with the flexed round sole portion of the other shoe with the toe and heel regions of one shoe fitting against the instep region of the other shoe, and a connecting element arranged around the peripheries of the interfitting sole portions to hold together adjacent parts of said peripheries, whereby release of said connecting element allows the two shoes to be separated for opening out into a pair of casual shoes.

2. A packaged pair of casual shoes as claimed in claim 1, wherein the sole portions are flexed round so that the upper portions of the shoes are disposed inwardly of the U-shape.

3. A packaged pair of casual shoes as claimed in claim 1, wherein there is provided on the sole portion of each shoe descriptive matter, embossed to upstand therefrom.

4. A packaged pair of casual shoes as claimed in claim 1, wherein there is provided on the sole portion of each shoe grip-enhancing structures, upstanding from the sole portion.

5. A packaged pair of casual shoes as claimed in claim 1, wherein the sole portion of each shoe is flexed in a direction transverse to the length of the shoe between the toe and heel regions, whereby the package of the inter-fitted shoes is generally spherical.

6. A packaged pair of casual shoes as claimed in claim 1, wherein the connecting element comprises an elongate cord laced between the stitching of the two shoes to interconnect said peripheries thereof, whereby removal of the cord releases the two shoes for separation and opening out into a pair of casual shoes.

7. A packaged pair of casual shoes as claimed in claim 6, wherein the stitching extends around substantially the entire periphery of the sole portion.

8. A packaged pair of casual shoes as claimed in claim 7, wherein a single cord is laced between the stitchings of the two shoes for substantially the whole of the peripheries of the two sole portions, whereby said two peripheries are held closely adjacent one another for substantially the entire extent thereof.

9. A packaged pair of casual shoes as claimed in claim 1, wherein the cord has two ends, said ends being tied together to resist the loosening of the cord until the tied ends are released.

10. A packaged pair of casual shoes as claimed in claim 9, wherein said pair of casual shoes comprises a pair of flip-flop shoes.

11. A packaged pair of casual shoes as claimed in claim 10, wherein said upper portion of each shoe is formed in two pieces, one of said pieces being stitched to the periphery of the sole portion at one side of the instep region and the other of said pieces being stitched to the periphery of the sole portion at the opposed side of the instep region.

12. A packaged pair of casual shoes as claimed in claim 11, wherein each of the two pieces of the upper portion includes a respective forwardly extending strip, the two strips being joined together to define a toe post for the shoe.

13. A packaged pair of casual shoes as claimed in claim 12, wherein the toe post is connected to the toe region of the sole portion.

14. A packaged pair of flip-flop shoes each shoe of said pair comprising a flexible sole portion having a periphery, said sole portion comprising a toe region at one end thereof, a heel region at the other end thereof and an instep region between said toe and heel regions, an upper portion formed in two parts each of which parts is connected by stitching to the instep region of the periphery of the sole portion at opposed parts thereof, each of said parts of the upper portion having a forwardly extending strip and each of said strips being attached together and to the toe region of the sole portion so as thereby to form a toe post for the shoe, and each sole portion of each shoe being flexed round generally into a U-shape to be interfitted with the flexed round sole portion of the other shoe with the toe and heel regions of one shoe fitting against the instep region of the other shoe, and an elongate cord laced between the stitching of the two shoes to interconnect said peripheries thereof, the cord having two ends secured together to resist separation of the shoes but removal of the cord releases the two shoes for separation and opening out into a pair of flip-flops.

15. A packaged pair of flip-flop shoes as claimed in claim 14, wherein the sole portions are flexed round so that the upper portions are disposed inwardly of the U-shape, and the sole portion of each shoe is flexed in a direction transverse to the length of the shoe between the toe and heel regions, whereby the package of the inter-fitted shoes is generally spherical.

* * * * *